United States Patent [19]

Grönlund et al.

[11] Patent Number: 4,771,704

[45] Date of Patent: Sep. 20, 1988

[54] DAMPING DEVICE IN A BOGIE FOR A RAILBOUND VEHICLE

[75] Inventors: Martin Grönlund; Tore Jonsson; Ingemar Persson, all of Västerås, Sweden

[73] Assignee: Asea Aktiebolag, Västerås, Sweden

[21] Appl. No.: 32,969

[22] Filed: Apr. 1, 1987

Related U.S. Application Data

[63] Continuation of Ser. No. 800,037, Nov. 20, 1985, abandoned.

[30] Foreign Application Priority Data

Nov. 22, 1984 [SE] Sweden ..... 8405892

[51] Int. Cl.[4] ..... B61F 5/08

[52] U.S. Cl. ..... 105/193; 105/198.2

[58] Field of Search ..... 105/185, 193, 207, 198.2

[56] References Cited

U.S. PATENT DOCUMENTS

| | | | |
|---|---|---|---|
| 2,333,921 | 11/1943 | Flesch | 105/197 DB |
| 2,675,765 | 4/1954 | Hamilton | 105/197 DB |
| 2,827,987 | 3/1958 | Williams | 105/197 DB |
| 2,908,231 | 10/1959 | Driemeyer et al. | 105/207 X |
| 3,411,458 | 11/1968 | Sinclair | 105/185 |

*Primary Examiner*—Sherman D. Basinger

*Attorney, Agent, or Firm*—Watson, Cole, Grindle & Watson

[57] ABSTRACT

A damping device in a bogie of a railbound freight car has good ride properties independent of the load carried by the car by making the damping device with friction wedges of triangular cross-section, an upper surface of which confronts an adjoining load-supporting bolster beam and is joined thereto through a tertiary spring element of high stiffness in the vertical direction and of relatively low stiffness in the lateral direction. A lower surface of each friction wedge adjoins the upper side of the respective bogie suspension unit.

12 Claims, 1 Drawing Sheet

DAMPING DEVICE IN A BOGIE FOR A RAILBOUND VEHICLE

This application is a continuation, of application Ser. No. 800,037, filed Nov. 20, 1985, now abandoned.

BACKGROUND OF THE INVENTION

The present invention relates to a railroad bogie and to a damping device in a bogie for a railbound vehicle.

The type of bogie to which the invention relates comprises two parallel, spaced-apart side frames, a spaced-apart pair of axles which are each journalled for rotation adjacent to respective end portions of each side frame, rail wheels adjacent each end of each axle, a transverse bolster beam which is articulated with the body of the railbound vehicle and which extends between respective mid-portions of the two side frames, each end portion of the bolster beam being resiliently linked to the respective side frame by means of a suspension unit, including at least one spring element, so as to permit limited movement of the bolster beam in the vertical and lateral directions (relative to the side frames), and a damping device acting between the respective spring elements and side frames comprising friction wedges for damping the vertical and lateral movements of the ends of the bolster beam relative to their respective side frames. These known damping devices comprise an elongated pair of opposed wedge members which are essentially triangular in cross-section, and thus each exhibit three longitudinal faces, one of these faces of each wedge member providing a friction surface held against a corresponding surface on the side frame by a resultant force developed via the other two faces of the respective wedge member.

DISCUSSION OF PRIOR ART

In rail cars in general, it is important, inter alia for reasons of comfort and safety, to achieve good ride properties under varying running conditions. This may be especially critical where freight cars are concerned, since the ride properties of freight cars can vary considerably, depending on whether they are run empty or fully loaded. One important factor influencing ride properties of a railbound vehicle is the suspension system of a vehicle. One method for achieving good ride properties, independent of load carried, is to have a progressive suspension system whose stiffness increases in the vertical and lateral directions with increasing load on a car. The problems of suspension systems in railway freight cars and an ingenious solution have been described in greater detail in U.S. patent application Ser. No. 800,036, filed Nov. 20, 1985, now abandoned, the contents of which are herein incorporated by reference.

Another important factor which influences the ride properties of a railroad vehicle having a bogie of the kind described above is the performance of the damping device for the spring elements.

One problem with prior art damping devices has been their inability to achieve optimum damping in both the vertical and the lateral direction over the wide range of loads carried by a freight car. The result of this has been that conventional freight cars cannot run faster on normal standard track, since the freight would be subjected to acceleration forces which exceed the permissible acceleration levels.

Another problem which occurs in prior art damping devices is that the normally convex side of the wedge member making contact with the bolster beam becomes flat with wear. This may give rise to the wedge members locking in the bolster beam, resulting in a loss of damping effect and causing instabilities in the ride of the rail car.

OBJECT OF THE INVENTION

The main object of the present invention is to eliminate the above-mentioned problems by using a damping device that provides optimum damping in both the vertical and lateral directions as part of a suspension system which gives rise to good ride properties irrespective of the load carried.

SUMMARY OF THE INVENTION

According to the invention the damping device is arranged to generate a damping force in the vertical direction which is, by and large, proportional to the load applied to the bolster beam. This load, transferred from the car body to the bolster beam by way of a center plate, is dependent on the maximum speed of the car and the track standard on which the car is running. In the case of inferior track conditions and at higher speeds, a larger damping force is therefore required. In the lateral direction, the damping device is required to exert an approximately constant damping action, which should be essentially independent of the load applied to the bolster beam by way of the center plate. In practice this means that the vertical and lateral damping actions, during empty load operations, are approximately equal, whereas in the case of full load conditions, the vertical damping action is considerably greater than the lateral damping action. To achieve this performance, the damping device described in the introductory part of the application is characterized in that the upper surface of the wedge member is arranged to make contact with the bolster beam by way of a pressure-resistant spring element which is relatively resilient in the lateral direction, whereas the bottom surfaces of each wedge member are arranged to make contact with the suspension unit. This results in a damping device having different damping actions in different directions, which in combination with a progressive suspension unit, preferably a rubber body arranged in series with the damping wedge members and being essentially spherical or partially spherical in the unloaded state, contributes to impart good ride properties to the rail car independently of whether the load carried is large or small. The suspension unit of the railroad bogie can have an essentially constant lateral stiffness with changing load and each pressure-resistant spring element of the damping device can have a degressive stiffness in the lateral direction with increasing load. The spring elements can have a lateral stiffness which is essentially as great as the lateral stiffness of the suspension unit in a loaded state and a vertical stiffness which is greater than the vertical stiffness of the suspension unit under any load condition.

BRIEF DESCRIPTION OF THE DRAWINGS

The invention will now be described in greater detail, by way of example, with reference to the accompanying drawing, wherein.

DESCRIPTION OF PREFERRED EMBODIMENT

Figure 1:
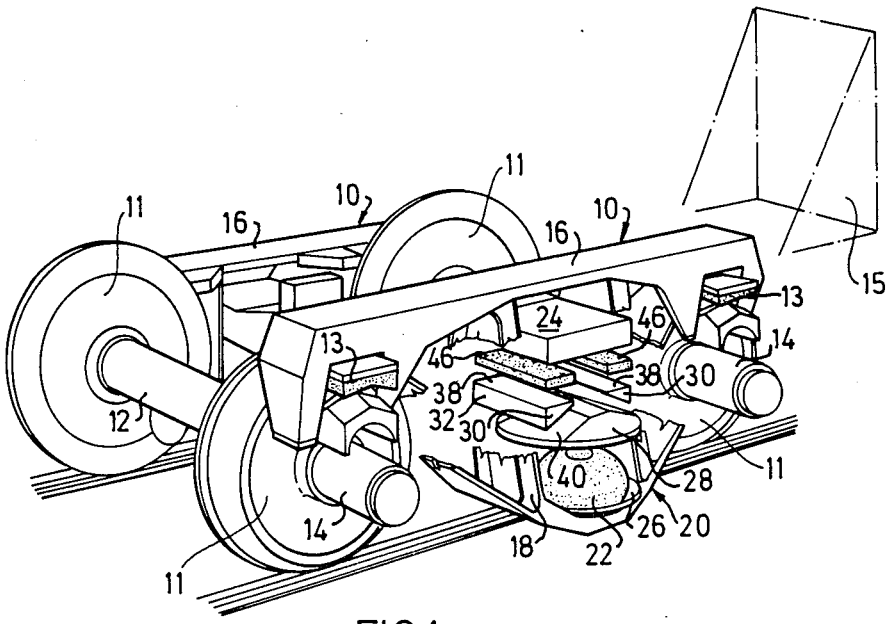
FIG. 1 is a schematic, partially exploded perspective overall view of a rail car bogie including a damping device according to the present invention.
Figure 2:
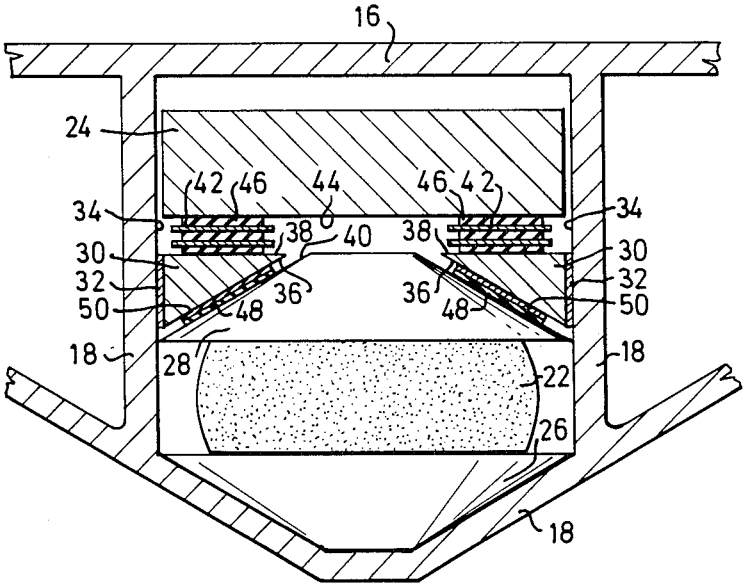
FIG. 2 is a schematic sectional side view on an enlarged scale of the central part of one side frame of the bogie of FIG. 1 with the damping device working in conjunction with a progressive suspension unit.

FIG. 1 shows a bogie which is intended to articulately support one end of a car body (shown schematically at 15) of a railbound freight car. The bogie is built up of two parallel spaced-apart side frames 10, at the end portions of which a parallel pair of axles 12 are rotatably journalled by means of journals 14. Bogie wheels 11 ride on the rails of the rail system as shown.

A primary suspension unit 13 is located between the side frames and each respective journal 14 and permits limited movements between the axles and the side frames. The side frames 10 are interconnected by means of a suitable structure (not shown) and have a top beam 16 with an essentially U-shaped bracket 18 which extends downwards from the mid-portion of the top beam 16, the lower part of which supports a secondary suspension unit 20 in the form of an elastic body 22 which is of essentially spherical form in the unloaded state. This spherical elastic body 22 constitutes a suspension unit of a progressive type which, dependent on the load, permits varying vertical and lateral movements of a transverse bolster beam 24 in relation to the side frames 10. The transverse bolster beam 24 extends between the side frames 10 and is articulately connected to the car body by way of a center plate (not shown) located in its mid-portion.

The elastic body 22 rests in a lower cup-shaped element 26 supported by the bottom part of the U-bracket 18, this lower cup-shaped element 26, in cooperation with a similar upper cup-shaped element 28 making contact with the upper side of the elastic body 22, controlling the deformation of the elastic body 22 and thus achieving the desired progressive suspension characteristic. Such a progressive suspension unit 20 is the subject of the above-mentioned concurrently filed patent application.

To achieve good ride properties which are independent of the load carried by the bogie described above, it is important to arrange—in addition to the progressive, secondary suspension unit 20—a damping device which is suitably adapted to the suspension unit. It has been established that good ride properties are, on the whole, obtained in the car independent of the load if the damping force in the vertical direction is chosen to be directly proportional to the load applied to the center plate on the bolster beam and the damping force in the lateral direction is chosen to be approximately constant and adapted to the weight of the bogie frame. In this way, the vertical and lateral damping forces are approximately equal in the case of a low load (an empty car) and the vertical force is considerably greater in the case of a full load.

To secure the required good ride properties, the bogie comprises a damping device consisting of two wedge elements 30, which have a triangular cross-section. Each of the wedge elements 30 has a friction surface 32, which makes contact with an opposing friction surface 34 on the inner side of a respective vertical wall of the U-bracket 18, a lower inclined surface 36, which makes contact with a parallel surface 40 on the upper side of the cup-shaped element 28, and an upper surface 38, parallel to the lower surface 44 of the end of the bolster beam 24. The surfaces 38 and 44 are preferably oriented horizontally, thus simplifying the construction of the bolster beam 24 as much as possible. The surfaces 38 and 44 may, however, incline obliquely upwards and outwards relative to the friction surface 34, for example at an angle corresponding to the inclination of the lower face 36 obliquely downwards and outwards relative to the friction surface 34.

In accordance with the invention, the bolster beam 24 is connected with the upper surface 38 of each wedge element 30 via a tertiary elastic (spring) element 46, which has a high stiffness in the vertical direction and a relatively low stiffness in the longitudinal direction of the wedge elements 30 and the bolster beam 24. The wedge elements 30 in their turn make contact in a force-transmitting manner with the upper surface of the secondary suspension unit 20. In this way, a vertical damping force is created, the magnitude of which varies in proportion to the applied vertical load, since the friction surfaces 32 of the wedge elements 30 are pressed wtih a greater or lesser force depending on the load, against the friction surfaces 34 of the side frame U-bracket 18. On the other hand, the damping effect in the lateral direction, i.e., the damping effect of the tertiary elastic elements on movement of the bolster beam 24 in its longitudinal dimension relative to the wedge elements 30, is essentially constant and thus independent of the load, due in turn to the special suspension properties of the tertiary suspension units 46. Each elastic element 46 may consist of a sandwich of three rubber sheets and two metal plates 42 vulcanized together.

According to a convenient embodiment of a damping device according to the invention, a laminate, consisting of a rubber layer 48 nearest to the cup-shaped element 28 and a low-friction lining 50 fixed to this rubber layer 48, may be located between the respective wedge elements 30 and the upper surface of the suspension unit 20. The task of the rubber layers 48 is, among other things, to accommodate small movements between the wedge elements 30 and the cup-shaped element 28 and to prevent, together with the low-friction lining 50, any self-locking tendencies of the wedge elements. The friction surface 32 may also consist of a friction lining fixed to a rubber layer (not shown). Additional factors influencing the magnitude of the damping forces are, of course, the friction coefficients of the friction materials as well as the magnitude of the angle between the lower and upper surfaces 36 and 38 of each wedge element 30. These values are chosen in such a way as to suit the damping forces to the spring characteristic of the suspension unit 20.

The invention is not limited to the structure illustrated, since many modifications thereof are clearly possible within the spirit and scope of the invention as set out in the following claims.

What is claimed is:

1. In a rail car bogie for movably supporting a rail car body vertically above a pair of railroad tracks, said rail car bogie comprising two spaced apart, parallel side frames for supporting the rail car body and the load provided thereby, said side frames having corresponding oppsite ends and which each includes a downwardly-extending support bracket having vertical side portions; a pair of axles which extend between said side frames near their corresponding opposite ends and are journalled for rotation with respect thereto; two rail wheels mounted on each said axle for rolling contact with railroad tracks; a bolster beam which extends between said side frames and is positioned so that opposite ends thereof are each located in a respective support bracket; a suspension unit mounted in each said support bracket below the associated end of said bolster beam to permit limited vertical and lateral movement of said bolster beam; and a damping means for damping the vertical and lateral movements of each end of said bolster beam, said damping means comprising at least one wedge member which is located between the associated end of said bolster beam, a side portion of the associated support bracket and the associated suspension unit, each wedge member being elongated in a transverse direction relative to said side frames, and each wedge member having a triangular cross section and providing three contact surfaces, a first contact surface of said three contact surfaces facing the side portion of the support bracket, a second contact surface facing the associated suspension unit and a third contact surface facing the associated end of said bolster beam, the improvement wherein said bolster beam is movable in its longitudinal dimension relative to each said wedge member, and wherein a separate elastic element is positioned between said third surface of each said wedge member and the associated end of said bolster beam, each said elastic element providing a high resistance to movement of the associated end of said bolster beam in a vertical direction and low resistance to lateral movement of the associated end of said bolster beam and allowing said bolster beam to move in its longitudinal dimension relative to each said wedge member.

2. A rail car bogie according to claim 1, wherein each said elastic element has an essentially constant low stiffness in the lateral direction and an essentially constant high stiffness in the vertical direction at a given load.

3. A rail car bogie according to claim 2, wherein each said elastic element is a tertiary spring element comprising three layers of elastomeric material sandwiched by, and bonded to, two sheets of metal.

4. A rail car bogie according to claim 2, wherein each suspension unit has an essentially constant lateral stiffness with changing load and wherein each said elastic element is a tertiary spring element which has a degressive stiffness characteristic in the lateral direction with increasing load beyond said given load.

5. A rail car bogie according to claim 4, wherein each said tertiary spring element has a lateral stiffness which is essentially as great as the lateral stiffness of the suspension unit in a loaded state.

6. A rail car bogie according to claim 5, wherein each said tertiary spring element has a vertical stiffness which is greater than the vertical stiffness of the suspension unit under any load condition.

7. A rail car bogie according to claim 4, wherein each said tertiary spring element has a vertical stiffness which is greater than the vertical stiffness of the suspension unit under any load condition.

8. A rail car bogie according to claim 1, including a resilient plate with a coating of a low friction material between each suspension unit and said second contact surface of each wedge member.

9. A rail car bogie according to claim 8, wherein said coating of low-friction material contacts the associated wedge member.

10. A rail car bogie according to claim 1, wherein said bolster beam has a flat lower surface, and wherein said third contact surface of each wedge member which faces the bolster beam is parallel to said flat lower surface of said bolster beam.

11. A rail car bogie according to claim 10, wherein the lower surface of the bolster beam is horizontal.

12. A rail car bogie according to claim 1, wherein said first contact surface of each wedge member consists of a wear-resistant friction lining.

* * * * *